United States Patent [19]

Price

[11] Patent Number: 4,970,974

[45] Date of Patent: Nov. 20, 1990

[54] TUFTING MACHINE BROKEN YARN DETECTOR

[75] Inventor: Herbert B. Price, Hixson, Tenn.

[73] Assignee: Spencer Wright Industries, Inc., Dalton, Ga.

[21] Appl. No.: 434,003

[22] Filed: Nov. 9, 1989

[51] Int. Cl.[5] ..... B65N 63/00; B65N 69/36; D05B 51/00

[52] U.S. Cl. ..... 112/80.18; 112/273; 112/278; 200/61.18

[58] Field of Search ..... 112/80.18, 273, 278; 66/163; 139/353; 28/187; 200/61.18, 61.13; 57/81

[56] References Cited

U.S. PATENT DOCUMENTS

| | | | |
|---|---|---|---|
| 3,529,560 | 9/1970 | Jackson | 112/80.18 |
| 4,522,139 | 6/1985 | Beverly | 112/273 |
| 4,570,560 | 2/1986 | Hubele | 112/273 |

*Primary Examiner*—Peter Nerbun

*Attorney, Agent, or Firm*—Alan Ruderman

[57] ABSTRACT

A tufting machine having a broken yarn detector including a multiplicity of yarn engaging fingers mounted in a support block secured to the frame of the tufting machine. Each finger has an eyelet at one end for receiving a strand of yarn and is pivotably mounted on a rod externally of the mounting block so that the fingers may be supported by the yarn in a raised position during normal operation, but pivotably drops when the yarn is broken. The rod is secured in position by a number of clamping blocks attached to the mounting block, the clamping blocks also having slots aligned with the slots in the mounting block at the location where the clamping blocks are secured for receiving the external ends of the fingers so as not to impede the pivotable movement. A light generator and a photoconductive receiver are mounted for detecting when a finger drops, the finger interrupting the transmission of the light beam to provide a signal which may be used to stop the tufting machine.

8 Claims, 2 Drawing Sheets

TUFTING MACHINE BROKEN YARN DETECTOR

BACKGROUND OF THE INVENTION

This invention relates to tufting machines and more particularly to the detection of broken yarn ends adjacent the needles of the machine and is an improvement of the detector disclosed in U.S. Pat. No. 4,522,139.

In a tufting machine more than 1,000 needles each carrying an individual yarn is employed for penetrating a backing material to insert loops of yarn therein, the loops being seized by a loop seizing looper or hook. Because of defects in the yarn itself or because of excessive tension or friction or other conditions, yarn breaks frequently occur before the yarn is stitched into the backing. When this occurs the product is defective and must be repaired as soon as the defect is detected. In some instances the defect goes undetected or is difficult to repair, especially when the gauge, i.e., the spacing between adjacent needles is fine or close, and the fabric produced is rendered defective which may require it to be discarded. Thus, it is highly desirable to detect a broken yarn end and stop the machine to repair the defect.

In the aforesaid patent assigned to the same assignee of the present invention, the prior art was discussed and a reliable broken yarn end detecting device was disclosed. That apparatus utilizes a multiplicity of yarn engaging fingers each having an eyelet for receiving a strand of yarn and being pivotably mounted in a support housing, the fingers normally being held in a raised position by the yarn, but dropped when the yarn passing through an eyelet of a finger is broken to provide a signal such as, for example, interruption of a light beam to activate a circuit for shutting power to the tufting machine motor to stop the machine.

Although the aforesaid apparatus is highly effective in operation, a number of maintenance and manufacturing problems result from the design thereof. For example, the fingers are supported in a housing through which a steel rod or shaft extends for pivotably mounting the fingers. Thus, a hole has to be drilled or bored through the housing for receiving the rod which supports the fingers which pivot relative to the rod within slots in the housing. Since it is difficult and expensive to drill a hole all the way through the housing, the housings are limited in length to approximately four inches thereby necessitating a substantial number of such housings to accommodate the need for a finger to correspond to each yarn end. Additionally, and of significance, is the fact that the fingers, which are formed from hardened steel, constantly pivot on the rod or shaft resulting in wear grooves being formed on the shaft. Eventually these rods or shafts wear out and must be replaced. Since the shaft extends all the way through the housing, and since the grooves in the shaft effect a distortion to the shaft, removal of the shaft from the housing is both difficult and time consuming. Furthermore, when a rod or shaft is removed from the block all of the fingers also are no longer held in the block. Thus, not only is it difficult to disassemble this apparatus, but it is also time consuming to reassemble all of the fingers associated with the rod or shaft. Another, and related, problem is that if one finger is bent or damaged so that it must be replaced the rod or shaft must be withdrawn completely because of the difficulty in attempting to merely remove it to the location of the

SUMMARY OF THE INVENTION

Accordingly, it is a primary object of the present invention to provide apparatus for reliably detecting broken yarn ends in a tufting machine having a plurality of thin planar fingers each including a yarn receiving eyelet through which yarn is threaded, a yarn end supporting each finger in a raised position and dropping the finger when yarn extending through the eyelet is broken, the apparatus including a rod or shaft for supporting the fingers in a housing, but the shaft not extending through the housing.

It is another object of the present invention to provide apparatus for reliably detecting broken yarn ends in a tufting machine having a plurality of thin planar fingers disposed in slots in a housing and pivotably mounted on a rod or shaft disposed outside of the housing by means of individual spaced apart clamping blocks so that when the shaft must be replaced, the clamping blocks merely have to be disassembled from the housing, and a replacement readily inserted through the fingers and clamped by the blocks.

It is a further object of the present invention to provide apparatus for readily detecting broken yarn ends in a tufting machine having a plurality of thin planar fingers each including a yarn receiving eyelet, the fingers being mounted within slots in the housing and pivotably supported on a rod externally of the housing, the rod being held in position by slotted clamping members at spaced apart locations permitting rapid assembly and disassembly of the apparatus when the rod or a finger must be replaced.

Accordingly, the present invention provides apparatus for a tufting machine having a multiplicity of yarn engaging fingers supported in a housing on a frame intermediate the yarn feed means and the needles for pivotable movement relative to the housing, each finger having an eyelet for receiving a strand of yarn which during normal operation of the machine supports the fingers in a raised position, but which when the yarn strand is broken drops to activate signal generating means preferably including means to stop the tufting machine so that an operator may rethread the needle associated with the broken yarn. The fingers are thin substantially planar members disposed within and pivotable relatively to respective slots in a portion of the housing. The fingers are pivotably carried on a rod mounted externally of the housing, the rod extending through a respective hole in the ends of the fingers remote from the eyelets. A small number of spaced apart clamping blocks are removably attached to the housing for clamping and positioning the rod, the clamping blocks also having slots disposed for alignment with the slots in the housing where the blocks are attached so as not to impede the pivotable movement of the fingers.

Assembly of the fingers merely requires disposing the fingers within the slots in the housing, inserting the rod through the holes in the fingers and securing the clamping blocks in place on the housing. When a rod has been damaged by wear due to the frictional engagement of the fingers with the rod, the blocks are merely disconnected from the housing, the rod removed and replaced, and the blocks reconnected. Additionally, if one or more fingers are broken or bent and must be replaced, only those blocks attached to a portion of the housing need be removed to permit the rod to pulled to the location for release of those fingers from the rod, new fingers inserted, the rod pushed back into place and clamped by the clamping blocks. Moreover, because no holes need to be drilled or bored in the housing, the housing can be made substantially longer than the prior art housings thereby minimizing the number of such units required to be installed in the tufting machine.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
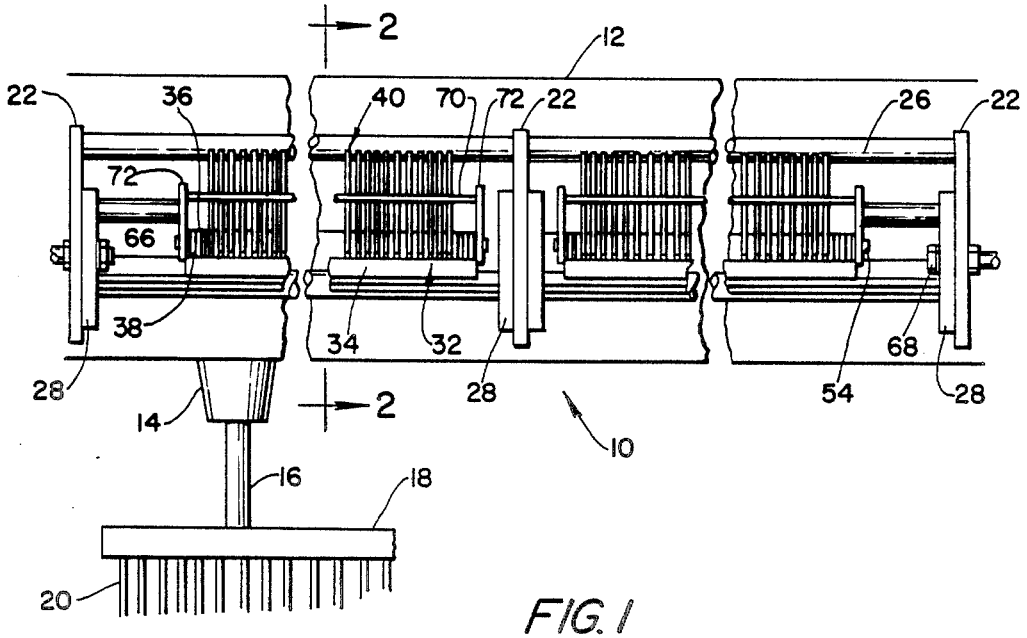
FIG. 1 is a front elevational view of a portion of a tufting machine incorporating apparatus constructed in accordance with the present invention, portions thereof being broken away for clarity of presentation.

Referring now the drawings, a portion of a tufting machine 10 is illustrated having a head 12 in which a plurality of bushings 14 are mounted, only one of which is illustrated. Each bushing journally supports a push rod 16 for vertical reciprocation in the head. The lower end of each push rod 16 supports a needle bar 18 which carries a multiplicity of needles 20, each of which is threaded with a strand of yarn Y fed to the needles. As is well known in the art the yarn may be fed by any yarn feed means such as rollers so that the yarn carrying needles penetrate a backing material supported beneath the head 12 for cooperation with loop seizing means beneath the backing material to form loops in the backing material which may or may not be cut, all of which is well known in the tufting art and thus not illustrated.

A typical tufting machine may incorporate 1,000 to 2,000 needles so that it is difficult, if not impossible, to visually determine when a particular yarn end has broken and thus the needle associated therewith is not forming loops. In a high speed tufting machine a large amount of defective fabric may result when such a break occurs, and when the gauge, i.e., the spacing between adjacent needles, is small, large defects are difficult to repair, thereby resulting in a substantial amount of wasted fabric.

In order to rapidly detect a yarn break and determine the location thereof, the aforesaid U.S. Pat. No. 4,522,139 proposed a yarn break detector which has functioned extremely well. The present invention, which is a modification of the broken yarn detector in the aforesaid patent provides a number of manufacturing and assembly advantages, and a substantial number of advantages when maintenance is required. Thus, each broken yarn detector unit of the present invention includes a frame comprising a pair of spaced apart brackets 22 mounted transversely across the tufting machine at the side thereof from which the yarn is fed to the needles. The number of broken yarn detector units across the machine is determined by the length of each unit and the width of the machine. Each bracket 22 has a base portion or foot (not illustrated) fastened to the head 12 of the tufting machine at a disposition above the bushings 14, and an enlarged generally triangular portion 24 extending from the foot remote from the head 12 of the tufting machine, as fully disclosed in the aforesaid U.S. Patent. The triangular portion 24 includes a bore within which a rod 26 is received and extends to span each pair of spaced brackets 22 and functions as a yarn guide. Adjustably secured to each bracket 22 on the surface facing cooperative adjacently spaced brackets is another bracket 28. An angle beam 30 or the like is secured to and spans each spaced apart pair of brackets 28. Fastened to the beam 30 is a plurality of substantially L-shaped finger support block members 32.

The support block members 32 have a base portion 34 and an upstanding leg 36. The base portion 34 is secured to the beam 30 in end-to-end fashion while the upstanding leg 36 has a plurality of slots 38 for accommodating a respective finger 40, each finger 40 corresponding to a yarn end, i.e., to each needle. Each finger 40 is a thin substantially flat member comprising hardened steel having diverging edges 42,44 which extend from a small tail section 46 external of the upstanding leg 36 of the support block 32 remote from the base portion 34 where the edges converge and join together by a smooth arcuate outer edge, toward the other end of the fingers where the edges first diverge and then the edge 42 sharply tapers back toward the edge 44 and is joined thereto at a larger arcuate outer edge 48. A yarn receiving eyelet 50 preferably of an oblong configuration having its major axis skewed relative to the edges of the fingers is formed in the enlarged end portion of each finger.

In order to mount the fingers 40 so that they pivot within respective slots 38, each finger 40 includes a bore in the tail end 46 which extends outwardly of the rear wall 52 of the upstanding leg 36, the bores when positioned within the slots 38 are aligned so as to receive a rod 54 therethrough, the rod defining an axis about which the fingers pivot. The rod 54 is removably held in place outside of the support block 32 by at least two spaced apart clamping blocks 56. Since the finger support blocks 32 in the preferred embodiment may be in the order of approximately 12 inches to 15 inches in length, three clamping blocks 32 are utilized so as to better support the rod 54, the clamping blocks being of a length in the order of approximately ⅝ inch relative to the direction of the rod 54, and may be spaced apart approximately 3½ inches.

Each clamping block 56 has a number of slots 58 of the same width as the slots 38 and which are aligned with the adjacent slots 38 of the upstanding leg when mounted thereon so that pivotable movement of the fingers associated therewith are not impeded during operation and during threading when the fingers are raised as described in the aforesaid patent. Each clamping block 56 has a longitudinally extending groove 60 adapted for receiving the rod 54, the groove 60 being of a V-shape sized so that when the block is clamped to the wall 52 the rod is frictionally secured against the walls of the groove and against the wall 52 so that the rod is fixed while the fingers 40 pivot relative thereto. Each clamping block 56 includes a bore 62 adjacent the bottom thereof below the slots 58 extending transversely relative to the groove 60 and the rod 54 for receiving a shoulder screw, bolt or the like 64 having threads for attachment into a tapped hole in the rear wall 52 of the leg 36 to secure the block 56 to the rear wall 52 of the mounting block 32, the bore 62 being elongated in the longitudinal direction, i.e., the direction of elongation of the rod 54, so that the blocks can be adjustably positioned slightly for alignment of the slots 58 with the slots 38.

In all other respects the apparatus of the present invention is similar to that of the aforesaid U.S. Pat. No. 4,522,139. Thus, a light transmitting element 66 mounted in the bracket 28 of a unit at one end of the tufting machine sends an axial beam toward a photoconductive light sensing element 68 mounted in another of the brackets 28 at the other end of the tufting machine. The elements 66 and 68 are disposed below the normal position of the fingers so that when a yarn end breaks the finger drops into the beam to interrupt reception of the beam from the transmitter 66 to the receiver 68. The transmitter 66 and sensor 68 are conventional and are connected through electrical circuitry in conventional manner to provide a signal when the light beam is interrupted, the signal preferably acting to shut power flow to the tufting machine motor to stop the machine to limit the amount of defective fabric produced.

Figure 2:
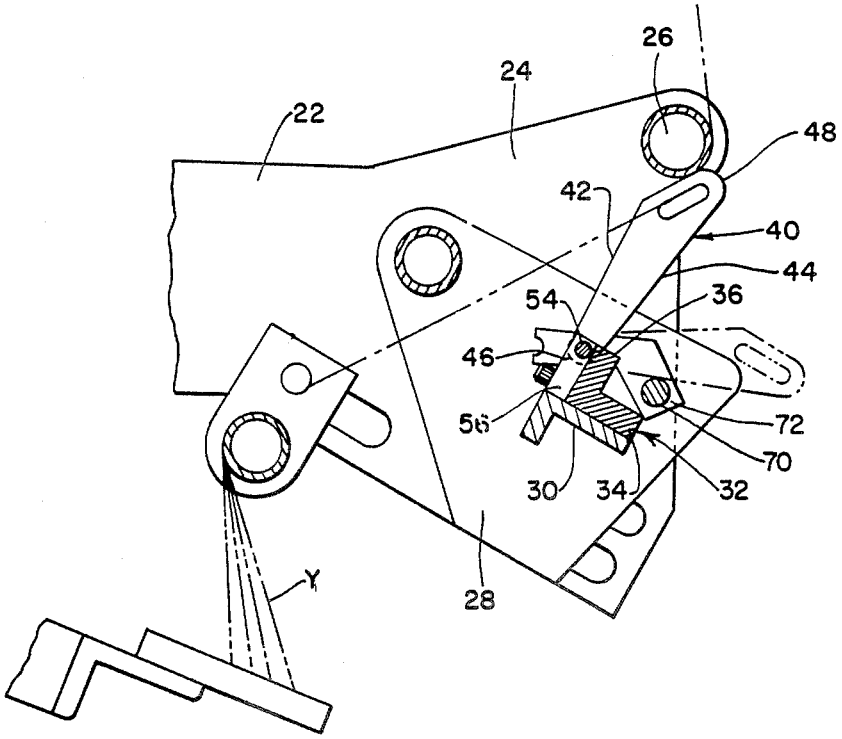
FIG. 2 is an enlarged cross sectional view of the apparatus taken substantially along line 2—2 of FIG. 1 with the fingers in the operative position.
Figure 3:
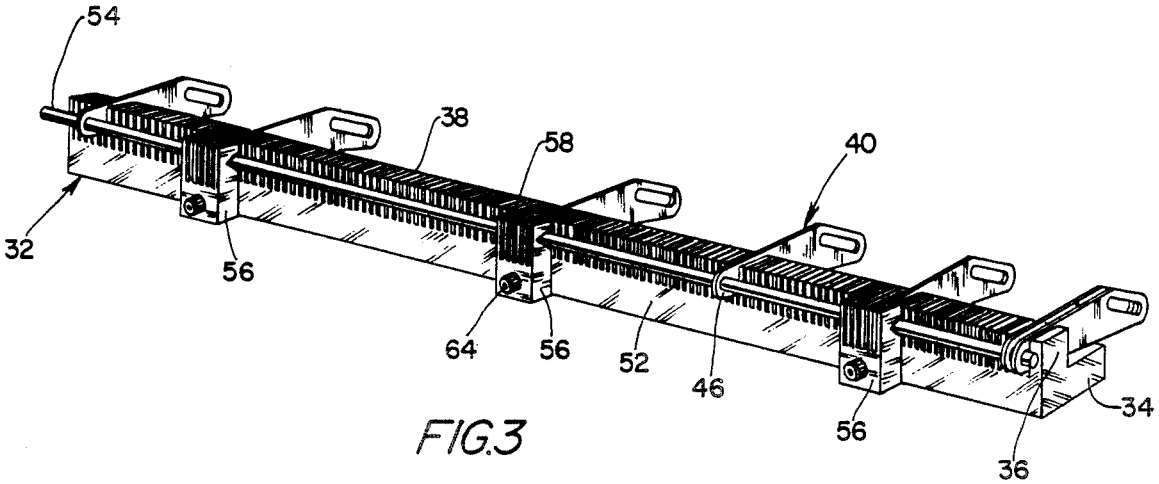
FIG. 3 is a rear perspective view of one unit of the apparatus with a substantial number of the fingers removed for clarity of presentation.
Figure 4:
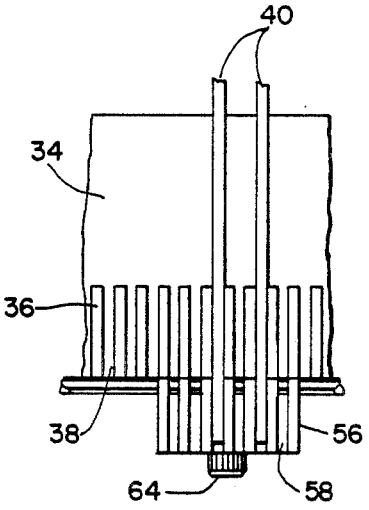
FIG. 4 is a fragmentary top plan view of a portion of FIG. 3.
Figure 5:
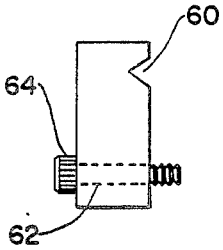
FIG. 5 is an end elevational view of a clamping block.

Additionally, the detector preferably includes means for raising all of the fingers 40 of a unit for threading as described and claimed in the aforesaid U.S. patent, the means including a rod 70 carried by a bracket 72 at each end of each support block member 32, i.e., each unit, the brackets being adapted to be disposed in the lower or operative position so as not to interfere with the operation of the fingers as illustrated in FIG. 2, or a raised position as illustrated in FIG. 1 for raising the fingers for threading of the needles.

It may thus be seen that assembly of a detector unit of the present invention may be readily performed merely by positioning the fingers 40 within the slots 38 of the support bracket 32, aligning the bores in the tail end 46 of the fingers so that the rod 54 may be inserted therethrough, and thereafter positioning the clamping block 56 so that the screw 64 is aligned for threading into the tapped hole in the wall 52 of the support block 32 with the tail ends of the small number of fingers associated with each block disposed in the slots 58 of the clamping blocks. The screws are thereafter tightened and the unit may be mounted in the tufting machine. After operating for a length of time such that the rod 54 requires replacement due to frictional wearing resulting from the constantly pivoting fingers, the clamping blocks 56 are disconnected or merely loosened from the mounting block 32 thereby to release the rod for removal from the holes in the tail ends of the fingers. As aforesaid, in the prior art apparatus this could not be readily accomplished because of the distortion of the worn rod, and requires substantial amount of effort. Remounting of the fingers is readily accomplished as aforesaid.

If a finger becomes bent or broken for some reason, only one or two of the clamping blocks need be removed while the other one or two clamping blocks need only be loosened so that the rod can be withdrawn to the location of the damaged finger, the finger replaced and the rod reinserted through the fingers from which it has been removed. For example, if a damaged finger is between one end of the mounting block 32 and the center clamping block 56, only the clamping block adjacent that one end need be removed or loosened while the other two clamping blocks would be loosened to withdraw the rod to the location of the damaged finger, the finger removed, a new finger inserted and the rod reinserted in the holes in the tail end of the fingers from which the rod had been removed. If a finger is damaged at the location of the central clamping block 56, in that instance one end block and the central block would have to be removed or loosened to withdraw the rod, and remove the finger. Accordingly, the present invention provides substantial advantages over the prior art apparatus in the area of assembly and maintenance. Furthermore, since a hole need not be bored through the mounting block, manufacturing costs are also reduced. Accordingly, the present invention provides substantial cost reduction advantages over the prior art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a multiplicity of yarn carrying needles mounted laterally across said machine, apparatus carried by said machine adjacent said needles for detecting a broken yarn, said apparatus comprising a frame supported on the tufting machine including a laterally extending mounting block having a multiplicity of laterally spaced apart slots, a multiplicity of substantially flat fingers disposed in respective slots, said fingers having planar laterally facing surfaces, means defining an eyelet extending through said surfaces for receiving a yarn strand such that each yarn strand may pass through a respective eyelet prior to receipt by a corresponding needle, a rod extending externally of said mounting block laterally through said fingers remote from said eyelet, a plurality of laterally spaced apart clamping blocks, means for removably securing said clamping blocks to said mounting block for securing said rod relative to said mounting block for permitting said fingers to pivot about said rod, said mounting block and fingers being disposed such that each finger is pivotably held in a raised position by a corresponding yarn strand and is pivotably dropped when the strand is broken, and signal generating means for generating a signal when a yarn strand is broken and the corresponding finger drops.

2. In a tufting machine as recited in claim 1, wherein each clamping block includes laterally spaced apart slots aligned with selected slots in said mounting block for receiving portions of fingers in said selected slots so as not to impede the pivotable movement of said fingers.

3. In a tufting machine as recited in claim 1, wherein said signal generating means comprises light beam transmitting means mounted on said frame at a location beyond a first lateral extreme of said fingers beneath the raised position of said fingers, and cooperating light receiving means mounted on said frame at a location beyond the other lateral extreme of said fingers beneath the raised position of said fingers for receiving said light beam when the fingers are in the raised position, said transmitting means and receiving means being disposed such that a dropped finger interrupts said beam.

4. In a tufting machine as recited in claim 2, wherein said clamping blocks include means for adjustably disposing said clamping blocks laterally for alignment of the slots therein with said selected slots in said mounting block.

5. A yarn break detector device comprising an elongated mounting block having a multiplicity of laterally spaced apart slots, a multiplicity of substantially planar fingers having first and second end portions disposed in respective slots, an eyelet in said first end portion for receiving a yarn strand for passage therethrough, said second end portion extending externally of said mounting block, a rod extending laterally externally of said mounting block, means for pivotably mounting each second end portion on said rod, and a plurality of laterally spaced clamping blocks removably secured to said mounting block for securing said rod so that said fingers may pivot relatively thereto.

6. A yarn break detector as recited in claim 5, wherein each clamping block includes laterally spaced apart slots aligned with slots in said mounting block at the location where said block is mounted for receiving fingers associated therewith so as not to impede the pivotable movement of said fingers.

7. A yarn break detector as recited in claim 6, wherein the lateral length of each clamping block is substantially smaller than the lateral length of said mounting block.

8. A yarn break detector as recited in claim 7, wherein said clamping blocks include means for adjustably disposing said clamping blocks laterally for alignment of the slots therein with said selected slots in said mounting block.

* * * * *